United States Patent [19]

Hoshi et al.

[11] Patent Number: 4,899,654

[45] Date of Patent: Feb. 13, 1990

[54] WIPING APPARATUS FOR INTAGLIO PRINTING PRESS

[75] Inventors: Toshio Hoshi; Noboru Okada, both of Chiba, Japan

[73] Assignee: Komori Printing Machinery Co., Ltd., Japan

[21] Appl. No.: 241,577

[22] Filed: Sep. 8, 1988

[51] Int. Cl.[4] ..... B41F 9/08

[52] U.S. Cl. ..... 101/167; 101/157; 101/247

[58] Field of Search ..... 101/155, 167, 247, 157

[56] References Cited

U.S. PATENT DOCUMENTS

| | | | |
|---|---|---|---|
| 2,987,993 | 6/1961 | Giori | 101/155 |
| 3,762,319 | 10/1973 | Gazzola etal. | 101/155 |
| 4,290,361 | 9/1981 | Fowler et al. | 101/247 X |
| 4,397,237 | 8/1983 | Makosch | 101/247 X |
| 4,499,825 | 2/1985 | Uno | 101/155 X |
| 4,676,157 | 6/1987 | Ichikawa et al. | 101/155 |

*Primary Examiner*—Clifford D. Crowder
*Attorney, Agent, or Firm*—Remy J. VanOphem

[57] ABSTRACT

In a wiping apparatus for an intaglio printing press, a piston rod actuating end of a fluid pressure cylinder is pivotally coupled to each eccentric bearing for supporting the wiping roller, and the fluid pressure cylinder is supported by an adjusting mechanism for slightly moving in an extendable direction of the piston rod. A doctor blade holding member and a press-side support member are coupled by a plurality of fixing screws. The support member is reciprocally supported relative to the press side in an attachment/detachment direction of the doctor blade. The eccentric bearings and both ends of the support member are coupled by cam mechanisms for interlocking pivotal movement of the eccentric bearings with reciprocal movement of the support member. A doctor blade contact pressure fine-adjusting mechanism reciprocates the holding member with respect to the support member. Belleville springs are inserted between heads of fixing screws and the doctor blade holding member. Compression springs having a lower spring constant than that of the belleville springs are inserted between the belleville springs and the heads of the fixing screws. Fixing screw removal preventive stoppers are arranged. A doctor blade contact pressure fine-adjusting unit is arranged between the holding member and the support member to reciprocate the holding member.

4 Claims, 5 Drawing Sheets

WIPING APPARATUS FOR INTAGLIO PRINTING PRESS

BACKGROUND OF THE INVENTION

The present invention relates to a wiping apparatus for wiping an excessive ink included in an ink supplied to a copperplate surface and attached to a portion except for a picture pattern in each printing cycle.

An intaglio printing press includes a copperplate cylinder on which a copperplate is mounted and an impression cylinder which is in contact with the copperplate. An image of an ink supplied to the outer surface of the copper plate is transferred to a sheet conveyed by a gripper of the impression cylinder from a sheet feeder through a swing pregripper, thereby performing printing. The printed sheet is conveyed by delivery chains and discharged.

A wiping apparatus is attached to an intaglio printing press of this type, as disclosed in Japanese patent laid-open (Kokai) No. 58-101060 and U.S. Pat. No. 3,762,319. The wiping apparatus includes a wiping roller rotated against the copperplate cylinder such that their surfaces travel in opposite directions, a plurality of brushes, pad surfaces of which are in contact with the surface of the wiping roller, and a doctor blade which is made of hard rubber and located downstream of the brush roller. The distal end of the doctor blade is in contact with the wiping roller. Of the ink supplied from the form roller of an inking apparatus to the copperplate surface, an excessive ink portion attached to portions around the recesses serving as a picture pattern is wiped by the wiping roller which is in rolling contact with the copperplate cylinder. Therefore, only the picture pattern of an ink applied to the recesses is transferred to the sheet. The wiping roller is dipped and rotated in a cleaning solution such as TRICLEN (tradename) stored in a cleaning solution tank. The ink transferred to the wiping roller by wiping can be removed by cleaning action of the cleaning solution and the brushes. The cleaning solution flowing along the circumferential direction of the wiping roller is removed by the doctor blade in the cleaning solution.

In ink wiping in such a wiping apparatus, if a contact pressure of the wiping roller abutting against the copperplate surface is excessively high, the ink in the recesses constituting the picture pattern is also removed. As a result, a very thin line cannot be printed. However, if the contact pressure is excessively low, the ink is left around the recesses, and the line width of the image is undesirably increased. As a result, the printed sheet blots. In addition, the ink is left on the entire surface of part of the non-picture pattern which results in poor appearance. In order to assure high quality of the printed matters, the contact pressure of the wiping roller abutting against the copperplate surface must be accurately adjusted. For this purpose, a conventional wiping apparatus includes a contact pressure adjusting unit.

A wiping roller contact pressure adjusting unit of this type is rotatably supported by wiping roller eccentric bearings, and these bearings are pivoted through a worm and worm wheel set or a screw shaft upon a manual operation with handles so that the wiping roller slightly comes close to or is slightly separated from the copperplate surface.

When the printing operation is temporarily interrupted, the printing cylinder is reset, and at the same time the wiping roller is separated from the copperplate surface. This operation is a manual operation in the conventional wiping apparatus and requires a skilled worker. Therefore, energy savings cannot be achieved. In addition, when the wiping roller is separated from the copperplate surface, the adjusted contact pressure is undesirably lost. When a printing operation is restarted, the contact pressure must be readjusted, thus resulting in time-consuming, cumbersome operations. It is also difficult to synchronize the right and left handles during the operation of the printing press.

When the contact pressure of the doctor blade is excessively high, the wiping roller is damaged. However, when the pressure is excessively low, the cleaning solution cannot be completely removed from the wiping roller to contaminate the copperplate surface. A conventional wiping apparatus includes a handle operated type contact pressure adjusting unit for moving the distal end of the doctor blade with respect to the surface of the wiping roller. The above-mentioned two adjusting units are used for attachment/detachment of the copperplate, the wiping roller, and the doctor blade.

However, in the conventional wiping apparatus described above, during interruption of the printing operation, when the eccentric bearings are operated with the corresponding handles to separate the wiping roller from the copperplate surface, the wiping roller is brought into contact with the doctor blade to damage the surface of the wiping roller. Therefore, detachment of the doctor blade comes first, thus degrading operability. If detachment of the wiping roller and then detachment of the doctor blade are performed, the surface of the wiping roller may be damaged by the distal end of the doctor blade. In addition, when contact pressure adjustment of the wiping roller is performed, a relative position between the wiping roller and the doctor blade is changed. The adjusted contact pressure of the doctor blade must be readjusted, resulting in time-consuming, cumbersome operations.

The doctor blade in the conventional wiping apparatus is held by a blade holder as an elongated plate-like holding member. The blade holder is fixed by a plurality of fixing screws to a fixing portion of the cleaning solution tank on the printing press side so that the holder is movable in the doctor blade attachment/detachment direction. A fine adjusting unit is arranged between the blade holder and the press-side fixing or support portion to move the blade holder relative to the fixing portion. During interruption of the printing operation, when the doctor blade is attached to or detached from the wiping roller, or when the contact pressure of the doctor blade with respect to the wiping roller is adjusted to prevent damage to the wiping roller and contamination of the copperplate surface by incomplete removal of the cleaning solution, the fixing screws must be loosened to cause the fine adjusting unit to move the blade holder. In addition, when the blade holder is removed so as to replace a doctor blade and brush pads with new ones, the fixing screws are fully loosened and the blade holder is removed.

In the conventional wiping apparatus, since the fixing screws are loosened with every movement of the blade holder, operability is degraded. In addition, the contact pressure of the doctor blade with respect to the wiping roller is changed before loosening and after fastening. For this reason, it is very difficult to adjust fastening of the fixing screws, requiring a skilled worker and resulting in a time-consuming operation. Furthermore, the removed fixing screws tend to be lost since they are separate members.

SUMMARY OF THE INVENTION

It is an object of the present invention to provide a wiping apparatus for an intaglio printing press wherein pressure adjustment of a wiping roller can be facilitated.

It is another object of the present invention to provide a wiping apparatus for an intaglio printing press, wherein automatic adjustment can be performed to achieve energy savings.

It is still another object of the present invention to provide a wiping apparatus for an intaglio printing press, wherein a contact pressure of a doctor blade with respect to the wiping roller can be easily adjusted.

It is still another object of the present invention to provide a wiping apparatus for an intaglio printing press, wherein durability of the wiping roller can be improved.

It is still another object of the present invention to provide a wiping apparatus for an intaglio printing press, wherein a contact pressure of the doctor blade with respect to the wiping roller can be set to be a substantially predetermined value.

It is still another object of the present invention to provide a wiping apparatus for an intaglio printing press, wherein the doctor blade can be easily removed.

According to an aspect of the present invention, a piston rod actuating end of a fluid pressure cylinder is pivotally coupled to each eccentric bearing for supporting the wiping roller, and the fluid pressure cylinder is supported by an adjusting mechanism for slightly moving it in an extendable direction of the piston rod.

The fluid pressure cylinder is used to automatically adjust the wiping roller. Automatic adjustment allows movement of the piston rod of the fluid pressure cylinder in synchronism with resetting of the printing cylinder during interruption of the printing operation, thereby separating the wiping roller from the copperplate cylinder through the eccentric bearings. At the time of restarting of the printing operation, the wiping roller is brought into contact with the copperplate cylinder in synchronism with setting of the printing cylinder. In this case, the wiping roller is brought into the copperplate cylinder within the stroke limit of the fluid pressure cylinder, and this limit is set by the adjusting mechanism for supporting the fluid pressure cylinder. The contact pressure of the wiping roller prior to interruption of the printing operation can be easily set at the time of restarting. If the contact pressure of the wiping roller is to be adjusted, the fluid pressure cylinder for supporting the adjusting mechanism is operated during the operation of the printing press.

According to another aspect of the present invention, a holding member for holding the doctor blade and a press-side support member are coupled by a plurality of fixing screws. The support member is reciprocally supported relative to the press side in an attachment-/detachment direction of the doctor blade. A wiping roller eccentric bearing and the doctor blade support member are coupled by cam mechanisms for interlocking pivotal movement of the eccentric bearings with reciprocal movement of the support member. A doctor blade contact pressure fine-adjusting mechanism is provided to reciprocate the holding member with respect to the support member. In addition, springs may be arranged in a plurality of spring holes formed in a support member surface opposite to the holding member to separate the holding member from the support member.

During interruption of the printing operation, when the eccentric bearings are pivoted to separate the wiping roller from the copperplate cylinder, the support member, which is movable relative to the press upon pivotal movement of the eccentric bearings, is moved to separate the doctor blade from the wiping roller. At the time of restarting of the printing operation, the doctor blade is attached in synchronism with attachment of the wiping roller. The contact pressure of the doctor blade is not changed before and after the interruption. Even if the contact pressure of the wiping roller is adjusted, the relative position between the wiping roller and the doctor blade is not changed. Readjustment of the doctor blade is not required. The contact pressure of the doctor blade can be fine-adjusted singly. In addition, when fixing screws for fixing the doctor blade are loosened, the holding member is moved by the biasing forces of the spring members and is separated from the support member. The distal end of the doctor blade is moved upward to prevent the doctor blade from interfering with removal of the wiping roller.

According to still another aspect of the present invention, belleville springs are inserted between heads of the fixing screws and the doctor blade holding member. Compression springs having a lower spring constant than that of the belleville springs are inserted between the belleville springs and the heads of the fixing screws, respectively. In addition, fixing screw removal preventive stoppers are arranged. A doctor blade contact pressure fine-adjusting unit is arranged between the doctor blade holding member and the support member to reciprocate the holding member.

When the contact pressure of the doctor blade with respect to the wiping roller is adjusted, the fine-adjusting unit is operated without loosening the fixing screws. The holding member is slid between the belleville springs and the support member to adjust the contact pressure. When the holding member is to be removed, the fixing screws are fully loosened, the holding member is removed together with the fixing screws whose removal is prevented by the stoppers biased by the coil springs. In order to fix the holding member again, the fixing screws are slightly loosened, and the compression springs are compressed. The belleville springs are then fixed while storing an elastic force. The doctor blade is removed by moving the support member by a separate mechanism.

BRIEF DESCRIPTION OF THE DRAWINGS

FIGS. 1 to 5 show a wiping apparatus for an intaglio printing press according to an embodiment of the present invention, in which:

FIG. 1 is a side view of the wiping apparatus;

FIG. 2 is an exploded plan view of the wiping apparatus;

FIG. 3 is a longitudinal sectional view of a doctor blade unit;

FIG. 4 is a view showing a schematic layout; and

FIG. 5 is a schematic side view of an intaglio printing press to which the present invention is applied.

DETAILED DESCRIPTION OF THE PREFERRED EMBODIMENT

Figure 1:
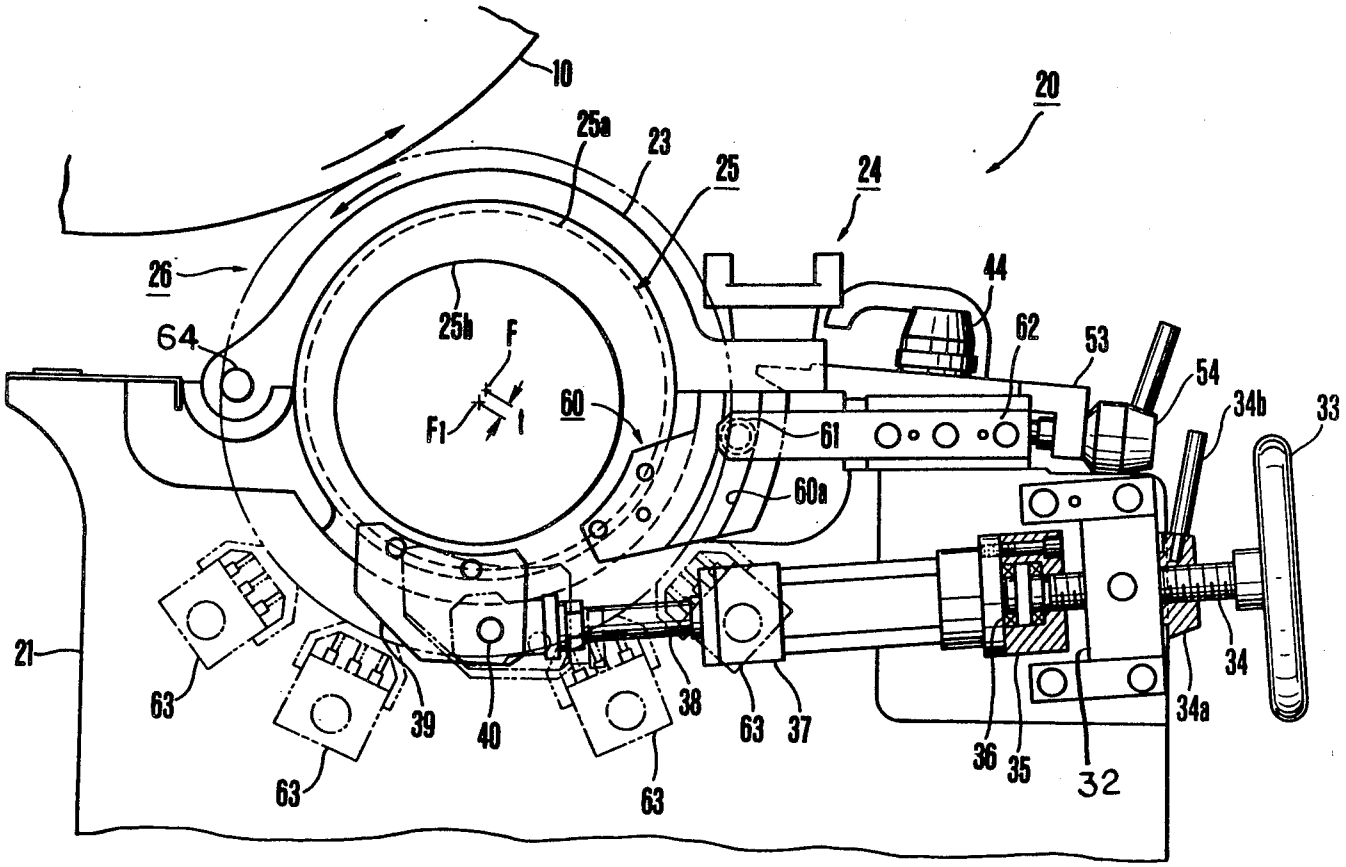
Figure 2:
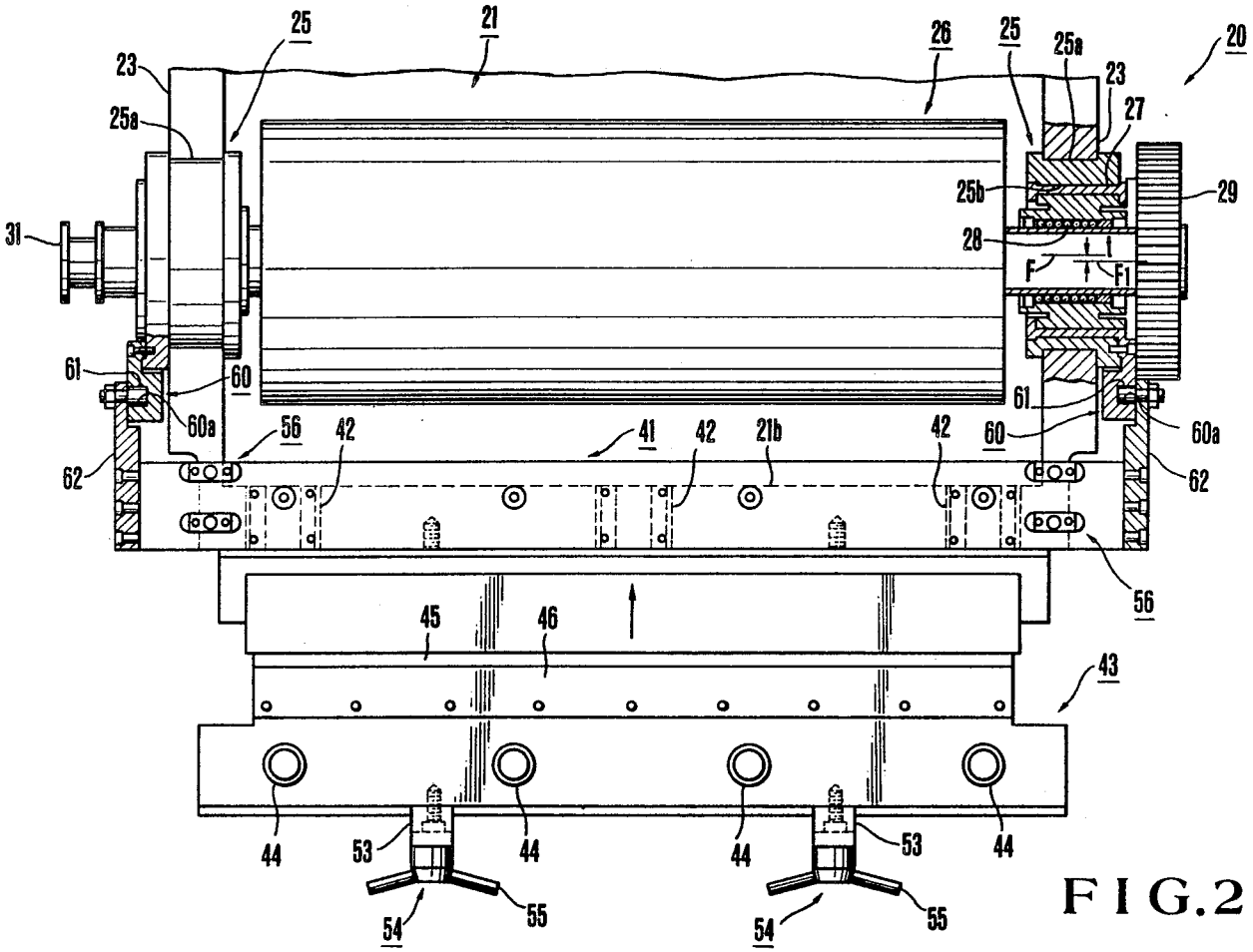

Referring to FIGS. 1 to 5, a feedboard 4 for receiving a sheet 1 fed one by one from the uppermost sheet by a sheet pick-up device of a sheet feeder 2, and a swing pregripper 5 for gripping the sheet 1 on the feedboard 4 and aligning it are arranged between the sheet feeder 2 on which sheets 1 are stacked and a printing unit 3 located in front of the sheet feeder 2. In the printing unit 3, three gripper units 8 each consisting of a gripper 6 and a gripper pad 7 are mounted at equal angular positions on the surface of an impression cylinder 9. A copperplate cylinder 10 having substantially the same diameter as that of the impression cylinder 9, a transfer cylinder 11 having a diameter substantially 1/3 that of the impression cylinder 9, and a delivery cylinder 12 having substantially the same diameter as that of the transfer cylinder 11 are in contact with the impression cylinder 9. The transfer cylinder 11 has one gripper unit as in the gripper unit 8 to transfer the sheet gripped from the swing pregripper 5 to the gripper unit 8 of the impression cylinder 9. A pair of right and left delivery chains 13 are looped between a sprocket (not shown) and a sprocket coaxial with the delivery cylinder 12. Delivery grippers are arranged along the delivery chains 13 to grip the sheet 1 from the gripper unit 8 of the impression cylinder 9 to convey the sheet 1 upon traveling of the delivery chains 13. A copperplate including a flat portion as a non-image portion and recesses constituting an image portion is mounted on the outer surface of the copperplate cylinder 10. A plurality of form rollers 14 are in contact with the surface of the copperplate. Duct rollers 16 rotated in ink fountains 15 are in contact with the corresponding form rollers 14. Reference numerals 17 denote vibrating rollers which are in contact with the corresponding duct rollers 16 to regulate uniform thickness of films of an ink supplied from the ink fountains 15.

Figure 4:
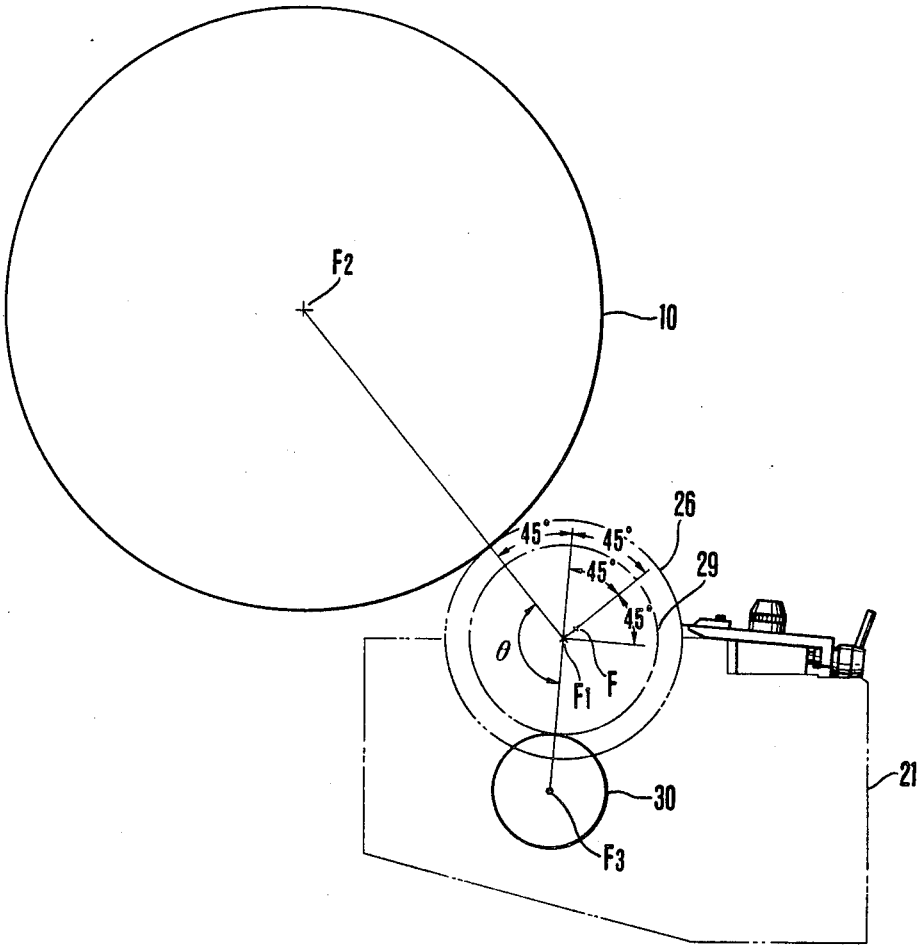
Figure 5:
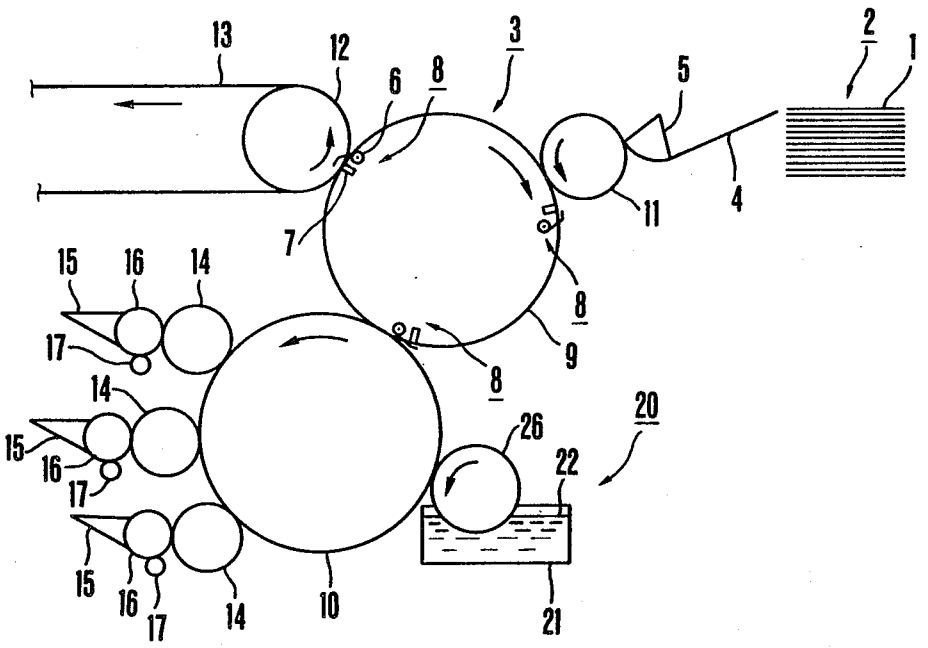

The intaglio printing press having the above arrangement includes a wiping apparatus 20. The wiping apparatus 20 include a cleaning solution tank 21 located obliquely below the copperplate cylinder 10 and supported on the press-side frame. A cleaning solution 22 such as TRICLEN (tradename) is stored in the cleaning solution tank 21. A pair of bearing covers 23 of a half-split hinge type pivotal about a shaft 64 are mounted on both side plates at the upper opening of the cleaning solution tank 21. The covers 23 are closed and fixed by a fastening metal piece 24. An eccentric bearing 25 is fixed by a split ring in each bearing cover 23 and is eccentric by a difference t between a metal axis F as the center of an outer surface 25*a* in FIG. 2 and a roller axis F1 as the center of an inner hole 25*b*. A wiping roller 26 is rotatably supported and axially reciprocated so as to be in contact with a copperplate surface of the copperplate cylinder 10 such that both ends of the wiping roller 26 are inserted into the inner holes 25*b* of the eccentric bearings 25 through bushes 27 and rolling bearings 28, respectively. The wiping roller 26 is driven from a motor side by a gear 29 fixed to one end of the wiping roller 26 and a pinion 30 located therebelow and meshed therewith, as illustrated in FIG. 4. The wiping roller 26 can be axially reciprocated by a swinging mechanism (not shown) obtained by fitting a roller on a slotted wheel 31 at the other end of the wiping roller 26. The rotational direction of the wiping roller 26 is the same as that of the copperplate cylinder 10, as indicated by arrows, so that the surfaces travel in opposite directions.

Screw bearings 32 each having a screw hole are bolted at the upper ends of both the side plates of the cleaning solution tank 21. A screw shaft 34 with a handle 33 is rotatably inserted into the screw hole of each screw bearing 32. Reference numeral 35 denotes a thrust bearing 36 built-in coupling pivotally mounted on the distal end of each screw shaft 34. A hydraulic cylinder 37 is coaxial with the corresponding screw shaft 34 and fixed to the corresponding coupling 35. A plurality of rods 38 is located immediately under the wiping roller 26. An actuation end of each piston rod 38 is pivotally fixed through a pin 40 to a metal piece 39 bolted to the corresponding eccentric bearing 25, so that the piston rods 38 of the hydraulic cylinders 37 can be reciprocated so as to pivot the eccentric bearings 25 about the metal axes F. Therefore, the wiping roller 26 can be brought into contact with the copperplate cylinder 10 or separated therefrom by an eccentric behavior. When the wiping roller 26 is in contact with the surface of the copperplate, the handles 33 are rotated to reciprocate the screw shafts 34. Therefore, the contact pressure of the wiping roller 26 can be fine-adjusted with respect to the surface of the copperplate. Reference numeral 34*a* denotes a fixing nut with a handle 34*b* which fixes the corresponding screw shaft 34 at a desired angular position.

Figure 3:
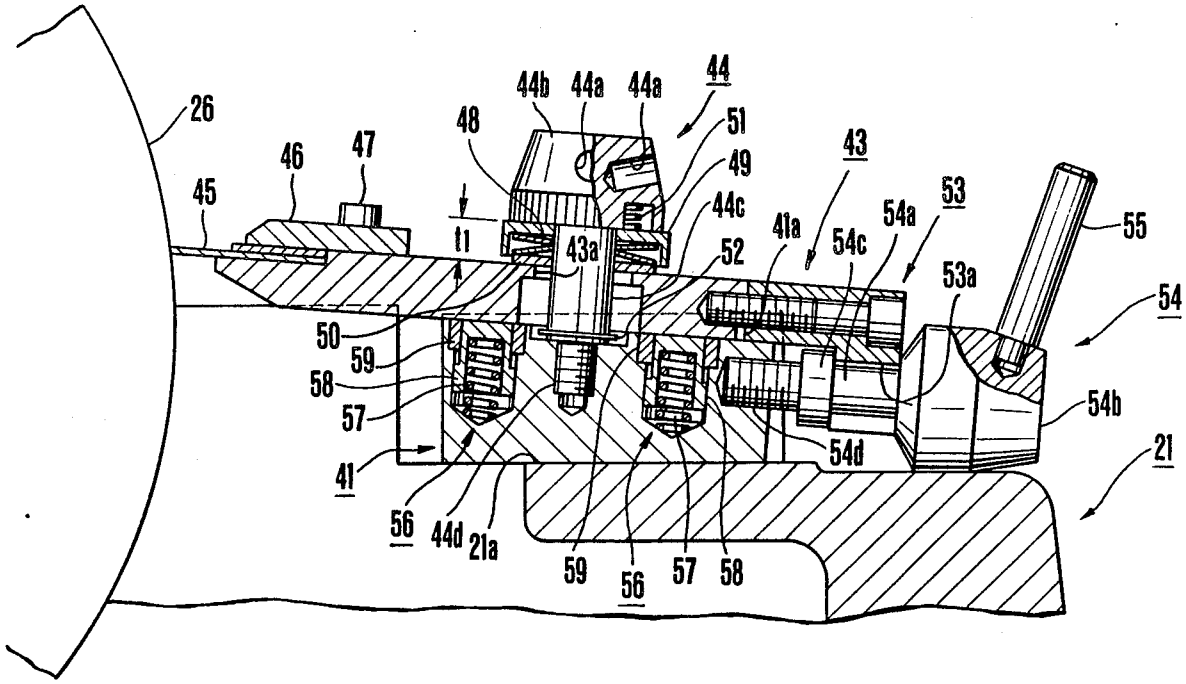

An elongated blade base 41 having a rectangular cross section is supported on the upper surface of a rear side plate 21*b* of the cleaning solution tank 21 so as to be guided in a direction perpendicular to the axis upon engagement of three dovetailed guides 42, i.e., two end guides and one central guide. Reference numeral 43 denotes a blade holder having a larger width but a smaller length than that of the blade base 41. The blade holder 43 overlaps an inclined surface 41*a* formed except for both ends of the blade base 41 and is detachably fixed by four fixing screws 44 (to be described later). A doctor blade (to be referred to as a blade hereinafter) 45 of a plate-like elastic member made of synthetic rubber or the like is pressed by a blade press member 46 and is fixed by a plurality of bolts 47. Each fixing screw 44 includes a head 44*b* with a plurality of handle insertion holes 44*a*, a pin portion 44*c*, and a male thread 44*d* threadably engaged in the corresponding screw hole of the blade base 41. A gap represented by reference symbol t1 in FIG. 3 is formed between the lower surface of the head 44*b* and the blade holder 43 at a limit position where the step between the pin portion 44*c* and the male thread 44*d* abuts against a fastening surface. A plurality of belleville springs 48 are clamped between caps 49 and washers 50 and are inserted in the gaps t1 of the respective fixing screws 44. Compression coil springs 51 are inserted in annular grooves of the heads 44*b*, respectively. Stoppers 52 are fitted on lower end portions of the pin portions 44*c*, respectively. Each fitting hole 43*a* for the pin portion 44*c* is a longitudinal hole having substantially the same width as that of the pin portion 44*c*. The stopper 52 abuts against an edge of the corresponding hole to prevent removal of the corresponding fixing screw 44. At the same time, the blade holder 43 can be moved to come close to or to be separated from the wiping roller 26. Right and left L-shaped blade holder moving metal pieces 53 are bolted at the right and left portions of the blade holder 43. Pin portions 54*a* of an adjusting screw 54 for adjusting the blade holder back and forth are respectively fitted in U-shaped grooves 53*a* of the vertical members of the metal pieces 53. The adjusting screw 54 includes the pin portions 54*a*, a head 54*b* with handle elements 55, a large-diameter portion 54*c* for regulating movement of the adjusting screw 54 together with the head 54*b*, and a male thread 54*d* threadably engaged with the corresponding screw hole formed in the blade base 41. The distal end of the blade 45 is in contact with the surface of the wiping roller 26 and wipes the cleaning solution which flows around the circumferential surface of the wiping roller 26. When the operator holds the handle elements 55 to reciprocate the adjusting screw 54, the blade 45 is reciprocated together with the blade holder 43. Therefore, the contact pressure of the blade 45 against the wiping roller 26 can be adjusted, or the blade 45 is separated from the wiping roller 26. In this case, even if the fixing screws 44 are kept fastened, the elastic forces of the belleville springs 48 are effected and the blade holder 43 can be reciprocated. A pair of front and rear spring mechanisms 56 are arranged at the left and the right end portions of the blade base 41 to bias the blade holder 43 away from the blade base 41. Each spring mechanism 56 includes a compression coil spring 57 fitted in a stepped spring hole in the blade base 41, a vertically movable stepped cap 58 capped on the compression coil spring 57, and a rectangular cap press member 59 bolted on the bottom surface of a longitudinal hole portion of the spring hole. The cap 58 which is not removed from the spring hole by the cap press member 59 is biased by the compression coil spring 57, thereby biasing the blade holder 43 upward.

The blade base 41 of the blade unit having the above arrangement is slightly reciprocally adjusted by the adjusting screws 54 and is reciprocated in synchronism with attachment/detachment of the wiping roller 26. Cams 60 having cam surfaces **60*a* which are not coaxial with the outer surfaces 25*a* and have arcuated grooves are bolted on the side surfaces of both the eccentric bearings 25, respectively. Cam levers 62 having free end portions which are pivotally mounted with cam followers 61 engaged with the cam surfaces 60*a* are bolted at both end portions of the blade base 41, respectively. With the above arrangement, the blade 45 is guided by the guides 42 and the eccentric bearings 25 are rotated. The cams 60 integrally formed with the eccentric bearings 25 are rotated about the metal axes F. The cam levers 62 are reciprocated back and forth while the vertical position is kept unchanged by the behavior of the outer surfaces 25*a* and the non-axial cam surfaces 60*a*. Therefore, the blade 45 is reciprocated. When the wiping roller 26 is separated from the copperplate cylinder, the blade 45 is separated from the wiping roller 26 accordingly. When the wiping roller 26 is brought into contact with the copperplate cylinder, the blade 45 is also brought into contact with the wiping roller 26. The contact pressure of the blade 45** in the contact state is kept unchanged before and after separation. Therefore, the contact pressure need not be readjusted.

The positional relationship of the wiping roller 26 and the like will be described with reference to FIG. 4. In this wiping apparatus, the position of the metal axis F falls within an angular range around the wiping roller axis F1 symmetrical about an angle $\theta$ defined by the copperplate cylinder axis F2, the wiping roller axis F1, and the pinion axis F3. More specifically, the position of the metal axis F falls within the range of $+45°$ with respect to a line perpendicular to a line connecting the wiping roller axis F1 and the copperplate cylinder axis F2. In addition, the position of the metal axis F falls within the range of $+45°$ with respect to a line extending from a line connecting the pinion axis F3 and the wiping roller axis F1. Within these ranges, the gear 29 is negatively shifted so as not to interfere with meshing of the gear upon pivotal movement of the eccentric bearing 25 and a change in axial distance between the gear 29 and the pinion 30. Even if the eccentric bearings 25 are pivoted, no problem occurs in meshing between the gear 29 and the pinion 30.

Referring to FIG. 1, reference numerals 63 denote a plurality of brushes, pad surfaces of which are supported by arms (not shown) so as to be brought into contact with the surface of the wiping roller 26. An ink transferred from the copperplate to the surface of the wiping roller 26 is removed into the cleaning solution tank 21 by a dissolution effect of the cleaning solution permeating into the pads and the urging pressure of the brushes 63.

In the intaglio printing press having the above arrangement, the sheet 1 fed one by one from the sheet feeder 2 to the feedboard 4 is gripped by the gripper unit 8 of the impression cylinder 9 through the swing pregripper 5 and the transfer cylinder 11. Inks of three colors in the ink fountains 15 are supplied by the form rollers 14 to the copperplate surface of the copperplate cylinder 10. These inks are transferred to the sheet 1 passing through the cylinders 9 and 10, thus performing printing. The printed sheet 1 is regripped by the grippers of the delivery chains 13 and is conveyed and discharged.

A wiping operation during printing will be described below. When sheet feeding is started and the printing cylinder is set, the hydraulic cylinders 37 are operated in synchronism with the above operations. The retracted piston rods 38 are extended to the illustrated positions, and the eccentric bearings 25 are pivoted clockwise about the metal axes F. The wiping roller 26 is urged against the copperplate. In this case, the cams 60 are pivoted clockwise in the illustrated positions. The cam followers 61 are engaged with the cam surfaces **60*a* to move the cam levers 62 forward. The blade base 41 integrally coupled to the cam levers 62 is moved parallel along the guides 42. The distal end of the blade 45 is brought into contact with the wiping roller 26. When printing is performed in this state, an excessive ink applied by the form rollers 14 to the portions around the recesses serving as the picture pattern of the copperplate surface is wiped by the wiping roller 26 and is transferred to the surface of the wiping roller 26. The transferred ink is removed into the cleaning solution tank by the cleaning behavior of the cleaning solution permeating into the pads of the brushes 63 and the pressure of the brushes 63. The cleaning solution flowing around the surface of the wiping roller 26 is removed by the blade 45 into the cleaning solution tank 21**.

In order to adjust the contact pressure of the wiping roller 26 with respect to the surface of the copperplate, the fixing nuts **34*a* are loosened and the handles 33 are rotated to reciprocate the screw shafts 34. The hydraulic cylinders 37 connected to the screw shafts 34 through the thrust bearings or couplings 36 are reciprocated to slightly pivot the eccentric bearings 25 in the same manner as described above. Therefore, the contact pressure of the wiping roller 26** can be fine-adjusted. This adjustment can be performed while wiping during printing is checked.

At the time of start of printing or wear after use for a long period of time, in order to adjust the wiping efficiency of the blade 45, the handle elements 55 are held to pivot the adjusting screws 54, the blade holder 43 is reciprocated and the blade 45 integrally formed therewith is also reciprocated. Therefore, the contact pressure of the blade 45 can be adjusted. In this case, in the conventional wiping apparatus, the screws corresponding to the fixing screws 44 are loosened to move the blade holder 43. However, in the wiping apparatus of this embodiment, the blade holder 43 is urged against the blade base 41 by the elastic forces of the belleville springs 48. Therefore, the blade 45 can be adjusted while the fixing screws 44 are kept fastened.

During interruption of printing, when sheet feeding is interrupted and the printing cylinder is released, the hydraulic cylinders 37 are synchronously operated. The piston rods 38 are moved backward, and the eccentric bearings 25 are moved in an opposite direction. The wiping roller 26 is separated from the copperplate surface by the eccentric effect. The cams 60 integrally coupled to the eccentric bearings 25 are rotated upon pivotal movement of the eccentric bearings 25. The blade base 41 is moved backward through the cam levers 62. The blade 45 is separated from the surface of the wiping roller 26. At the time of restarting of printing, when paper feeding is started to set the printing cylinder, the piston rods 38 of the hydraulic cylinders 37 are synchronously moved forward. In the same manner as in the start of printing, the wiping roller 26 and the blade 45 are synchronously operated and are brought into contact with each other. During attachment/detachment of the wiping roller 26, as described above, the relative position between the blade holder 43 and the blade base 41 is not changed. At the time of restarting of printing, the contact pressure of the blade 45 is the same as that prior to the interruption of printing. The blade 45 is separated from the wiping roller due to positional setting of the metal axis F and the shape of the cam surfaces 60*a*. The wiping roller 26 then follows the blade 45. The distal end of the blade 45 does not interfere with the surface of the wiping roller 26. The position of the metal axis F is properly set, and a meshing depth between the gear 29 and the pinion 30 is not increased or decreased so as to interfere with the operation.

When the pads of the brushes 63 are worn and a hand is inserted into the brush from the upper direction, or when the blade 45 is worn, the blade holder 43 is removed. When the handle is inserted into the handle insertion hole 44*a* of each fixing screw 44 to loosen it, the corresponding male thread 44*d* is removed from the screw hole, the elastic force of the corresponding belleville spring is released, and the elastic force of the corresponding coil spring 57 acts on the lower surface of the blade holder 43. The elastic force is balanced with the weight of the remaining portion of the blade holder 43, so that the blade holder 43 is moved upward horizontally or in an inclined state wherein the blade side of the blade holder 43 is higher than the opposite side thereof. In order to prevent erroneous supply of the cleaning solution during idling of the wiping roller 26, if the distance between the distal end of the blade 45 and the surface of the wiping roller 26 is 1 mm or less, the distal end of the blade 45 is not brought into contact with the surface of the wiping roller 26. When the male thread 44*d* is completely removed, the corresponding stopper 52 is urged against the longitudinal fitting hole 43*a* by the elastic force of the corresponding compression coil spring 51. Therefore, the blade holder 43 is removed together with the fixing screws 44. When a replacement operation or the like is completed and the blade holder 43 is attached again, the blade holder 43 is placed on the blade base 41, and the handle is inserted into each handle insertion hole 44*a* to engage the male thread 44*d* of the fixing screw 44 with the corresponding screw hole. In this case, the corresponding compression coil spring 51 is compressed, and the fixing screw 44 is threadably engaged such that the step of the pin portion 44*c* of this fixing screw 44 abuts against the stepped portion of the screw hole while the elastic force is accumulated by the corresponding belleville spring 48. As a result, the blade holder 43 is reciprocally supported by guiding the longitudinal fitting holes 43*a* by the pin portions 44*c*.

In the wiping apparatus for an intaglio printing press according to the present invention as described above, the piston rod actuating ends of the fluid pressure cylinders are pivotally supported by the eccentric bearings for supporting the wiping roller. The fluid pressure cylinders are supported by the fine-adjusting mechanism in the reciprocal direction of each piston rod. During interruption of printing, the wiping roller is separated from the copperplate cylinder by the fluid pressure cylinders. At the time of restarting of printing, the wiping roller is brought into contact with the copperplate cylinder by the stroke limit of each fluid pressure cylinder. In this manner, the contact pressure of the wiping roller prior to the interruption of printing can be kept unchanged. At the time of restarting of printing, the contact pressure need not be adjusted to reduce labor, and the interruption time can be shortened to improve productivity. The fluid pressure cylinders can be easily automated, and attachment/detachment of the wiping roller is interlocked with that of the printing cylinder. In this manner, a skilled person for attachment/detachment of the wiping roller is not required to achieve energy savings. The contact pressure of the wiping roller can be adjusted independently of attachment/detachment thereof during the operation of the printing press. In other words, contact pressure adjustment of the wiping roller can be performed while wiping is being checked, thus improving the wiping function.

Furthermore, in the intaglio printing press according to the present invention as has been apparent from the above description, the holding member for holding the doctor blade and the press-side support member are coupled by the plurality of fixing screws. The support member is reciprocally supported relative to the press side in an attachment/detachment direction of the doctor blade. The wiping roller eccentric bearings and the doctor blade support member are coupled by cam mechanisms for interlocking pivotal movement of the eccentric bearings with reciprocal movement of the support member. At the same time, the doctor blade contact pressure fine-adjusting mechanism is arranged to reciprocate the holding member relative to the support member. The eccentric bearings are pivoted at the time of interruption of printing and at the time of restarting of printing to separate the wiping roller from the copperplate cylinder and bring the wiping roller into contact with the copperplate cylinder. The doctor blade is separated from the wiping roller through the cam mechanisms and brought into contact therewith in synchronism with the operation between the wiping roller and the copperplate cylinder, thereby improving operability, facilitating automation, and hence achieving energy savings. During attachment/detachment, the relative position between the blade holder and the press-side support member is kept unchanged, and the contact pressure of the doctor blade is also kept unchanged. The contact pressure need not be readjusted at the time of restarting of printing. Therefore, the interruption time can be shortened and productivity can be improved. By arbitrarily setting a shape of the cam surface, the distal end of the doctor blade is not brought into contact with the surface of the wiping roller when the doctor blade is removed. The surface of the wiping roller is not damaged to improve durability. In addition, the shape of the cam surface is properly determined, so that the blade is not urged in the initial period of removal of the wiping roller and the blade can be slightly separated from the surface of the wiping roller at the end of removal. Therefore, damage to the surface of the wiping roller by impact caused by backlash during rotation, starting, and stopping of the roller can be prevented. The relative position between the holding member and the support member can be adjusted. Wiping roller deterioration over time can be easily compensated, thus improving the function of the wiping apparatus.

The spring members are fitted in spring holes formed in the support member surface opposite to the holding member to bias the holding member so as to separate it from the support member. In order to remove the doctor blade, when the fixing screws are loosened, the holding member is moved upward by the elastic forces of the spring members and the doctor blade is separated from the surface of the wiping roller. Therefore, damage to the surface of the wiping roller can be prevented.

Furthermore, in the wiping apparatus for an intaglio printing press according to the present invention as has been described above, each belleville spring is inserted between the flat surface of the holding member and the corresponding head of the fixing screw for fixing the doctor blade holding member to the press-side support member. Each compression coil spring having a lower spring constant than the corresponding belleville spring is inserted between this belleville spring and the corresponding head of the fixing screw. In addition, each fixing screw removal preventive stopper is fitted on the corresponding fixing screw. The doctor blade contact pressure fine-adjusting unit is arranged between the holding member and the support member to reciprocate the holding member. When the contact pressure fine-adjusting unit is operated, the holding member is slid and moved between the belleville springs and the support member. Therefore, the contact pressure of the doctor blade with respect to the wiping roller can be adjusted without loosening the fixing screws. As compared with the conventional case wherein the degree of loosening of the fixing screws must be adjusted by a skilled person, operability of the wiping apparatus can be improved. At the same time, since the contact pressure of the doctor blade can be adjusted without loosening the fixing screws, and readjustment of the contact pressure is not required, the interruption time can be shortened, and productivity can be improved. In order to remove the doctor blade together with the holding member, the fixing screws are fully loosened, the fixing screws are biased by the compression coil springs but cannot be independently removed by the stoppers. The fixing screws are, therefore, removed together with the holding member. The fixing screws will not be lost. In order to fasten the fixing screws, the compression coil springs and then the belleville springs are compressed. The screws can be easily threadably engaged with the screw holes, thus improving operability. In addition, the belleville spring produces a large spring force by fastening.

The present invention is not limited to the particular embodiment described above. Various changes and modifications may be made within the spirit and scope of the invention.

In the above embodiment, a hydraulic cylinder is used as the fluid pressure cylinder. However, an air cylinder may be used in place of the hydraulic cylinder. In addition, the adjusting mechanism which supports the fluid pressure cylinder to fine-adjust the piston rod in the reciprocal direction is not limited to the arrangement exemplified in the above embodiment.

What is claimed is:

1. A wiping apparatus for an intaglio printing press, comprising:

a wiping roller supported in inner holes of right and left eccentric bearings and operated such that a surface of said wiping roller is brought into contact with a copperplate surface of a copperplate cylinder or separated therefrom upon pivotal movement of said eccentric bearings;

a doctor blade held by a blade holder and operated such that a distal end of said doctor blade is brought into contact with the surface of said wiping roller or separated therefrom;

a blade base mounted on an intaglio printing press side;

a plurality of fixing screws for coupling said blade holder and said blade base to support said blade base so as to be reciprocated in an attachment-/detachment direction of said doctor blade with respect to said intaglio printing press side;

cam mechanism coupling said eccentric bearings to both ends of said blade base, respectively, to interlock pivotal movement of said eccentric bearings with reciprocal movement of said blade base; and a doctor blade contact pressure fine-adjusting mechanism for reciprocating said blade holder relative to said blade base.

2. The wiping apparatus of claim 1 wherein each of said eccentric bearings have an outer bearing portion pivotably received in a support hole provided in the side plates of said intaglio printing press and an inner hole in which said wiper roller is rotatably supported, the axis of said support hole and inner hole being eccentric and wherein said wiping apparatus further comprises:

a pair of fluid pressure cylinders, each cylinder having a piston rod, the end of which is pivotably supported by said outer bearing portion of respective one of said eccentric bearings, said fluid pressure cylinders being arranged to bring said surface of said wiping roller into contact with said copperplate surface and to separate said surface of said wiping roller from said copperplate surface upon the reciprocation of said piston rods; and a fine-adjustment mechanism for adjusting said fluid pressure cylinders in the direction of said reciprocation of said piston rods.

3. A wiping apparatus for an intaglio printing press, comprising:

a wiping roller supported in inner holes of right and left eccentric bearings and operated such that a surface of said wiping roller is brought into contact with a copperplate surface of a copperplate cylinder or separated therefrom upon pivotal movement of said eccentric bearings;

a blade holder;

a doctor blade held by said blade holder and operated such that a distal end of said doctor blade is brought into contact with the surface of said wiping roller or separated therefrom;

a blade base mounted on an intaglio printing press side;

a plurality of fixing screws for coupling said blade holder to said blade base to support said blade base so as to be reciprocated in an attachment/detachment direction of said doctor blade with respect to said intaglio printing press side;

cam mechanisms coupling said eccentric bearings to both ends of said blade base, respectively, to interlock pivotal movement of said eccentric bearings with reciprocal movement of said blade base;

a doctor blade contact pressure fine-adjusting mechanism for reciprocating said blade holder relative to said blade base; and spring members respectively fitted in a plurality of spring holes formed in a blade base surface opposite to said blade holder to bias said blade holder so as to separate said blade holder from said blade base.

4. A wiping apparatus for an intaglio printing press, comprising:

an elongated blade base horizontally supported on a cleaning solution tank side;

an elongated blade holder placed on said blade base;

a doctor blade which is fixed on said blade holder and a distal end of which faces a surface of a wiping roller;

a plurality of fixing screws each including a head, a pin portion, and a male thread, said pin portion being fitted in a corresponding one of longitudinal holes of said blade holder, and said male thread being threadably engaged in a corresponding one of screw holes of said blade base;

belleville springs each inserted between a flat surface of said blade holder and a corresponding one of said heads of said fixing screws, said belleville springs accumulating elastic forces for urging said blade holder into contact with said blade base such that said blade holder is reciprocally moved;

a doctor blade contact pressure fine-adjusting unit, coupled to said blade holder and said blade base, for reciprocating said blade holder;

fixing screw removal preventive stoppers each having a larger size than a diameter of each of said longitudinal holes and fitted on a corresponding one of said pin portions of said fixing screws; and compression coil springs inserted between said belleville springs and said heads of said fixing screws, respectively, and each having a spring constant smaller than that of each of said belleville springs.

* * * * *

UNITED STATES PATENT AND TRADEMARK OFFICE
CERTIFICATE OF CORRECTION

PATENT NO. : 4,899,654

DATED : February 13, 1990

INVENTOR(S) : Hoshi et al

It is certified that error appears in the above-identified patent and that said Letters Patent is hereby corrected as shown below:

Column 1, line 14, delete "copper plate" and insert ---- copperplate ----.

Column 3, line 59, delete"attachment-" and insert ---- attachment ----.

Column 5, line 36, delete "include" and insert ---- includes ----.

Column 6, line 6, after "of" insert ---- piston ----.

Column 7, line 41, delete "the" and insert ---- their ----.

Column 7, line 60, delete "+45°" and insert "±45°".

Column 7, line 64, delete "+45°" and insert "±45°".

Column 9, line 40, delete "hand" and insert ---- handle ----.

Column 12, line 30, delete "attachment-" and insert ---- attachment ----.

UNITED STATES PATENT AND TRADEMARK OFFICE

CERTIFICATE OF CORRECTION

PATENT NO. : 4,899,654

DATED : February 13, 1990

INVENTOR(S) : Hoshi et al

It is certified that error appears in the above-identified patent and that said Letters Patent is hereby corrected as shown below:

Column 12, line 33, delete "mechanism" and insert ---- mechanisms ----.

Column 12, line 50, after "of" insert ---- a ----.

Signed and Sealed this

Twenty-third Day of July, 1991

*Attest:*

*Attesting Officer*

HARRY F. MANBECK, JR.

*Commissioner of Patents and Trademarks*